US005535910A

United States Patent [19]

Cassel

[11] Patent Number: 5,535,910

[45] Date of Patent: Jul. 16, 1996

[54] STAKABLE REFUSE CONTAINER WITH IMPROVED HANDLE AND LID DRAIN

[75] Inventor: Timothy S. Cassel, Arlington, Mass.

[73] Assignee: Tucker Housewares, Leominster, Mass.

[21] Appl. No.: 327,707

[22] Filed: Oct. 24, 1994

Related U.S. Application Data

[63] Continuation-in-part of Ser. No. 19,209, Feb. 25, 1994.

[51] Int. Cl.[6] ..... B65D 51/24

[52] U.S. Cl. ..... 220/212; 220/DIG. 6; 220/771; 220/908; 206/508

[58] Field of Search ..... 220/908, 771, 220/772, 608, 571, DIG. 6, 212; 206/508, 509; 16/110 R

[56] References Cited

U.S. PATENT DOCUMENTS

| | | | |
|---|---|---|---|
| 2,061,610 | 11/1936 | Burnette | 220/608 |
| 3,757,385 | 9/1973 | Schwarzkopf | 16/110 |
| 4,013,105 | 3/1977 | Uuskallio | 220/DIG. 6 |
| 4,390,110 | 6/1983 | Pirro | 220/908 |
| 4,648,522 | 3/1987 | Wise | 206/508 |
| 4,779,754 | 10/1988 | Ten Eyck et al. | 220/DIG. 6 |
| 4,801,035 | 1/1989 | Sugiyama et al. | 220/DIG. 6 |
| 4,892,213 | 1/1990 | Mason, Jr. | 206/508 |
| 4,905,858 | 3/1990 | Budenbender | 220/DIG. 6 |
| 4,928,839 | 5/1990 | Kruelskie | 206/508 |
| 5,184,836 | 2/1993 | Andrews, Jr. et al. | 220/908 |
| 5,476,186 | 12/1995 | Reilly | 220/212 |

FOREIGN PATENT DOCUMENTS

| | | | |
|---|---|---|---|
| 848726 | 9/1960 | United Kingdom | 206/508 |

*Primary Examiner*—Stephen J. Castellano
*Attorney, Agent, or Firm*—Darby & Darby

[57] ABSTRACT

A refuse container and corresponding lid for storing and transporting goods, wherein the lid is slightly domed and provided with one or more drain channels for conducting accumulated liquid out of a recessed portion of the lid. The container is also provided with handles having a double vertical wall support structure at the point of attachment to the container for increasing the rigidity and vertical and lateral load bearing capacity of the handle. The bottom of the container is shaped to correspond to the lid to allow for vertical stacking and to limit the lateral motion of the stacked containers. The container bottom also contains radially extending ribs which provide additional material to wear away when the container is dragged over floor surfaces. The ribs, which provide a very small contact patch area, reduce friction when the container is dragged over a floor surface. Also, the container bottom is provided with an indented hand grip which assists in the handling of the container. The hand grip may also be used as a yoke to position the container on a person's shoulder when the container is carried in an overhead manner.

9 Claims, 4 Drawing Sheets

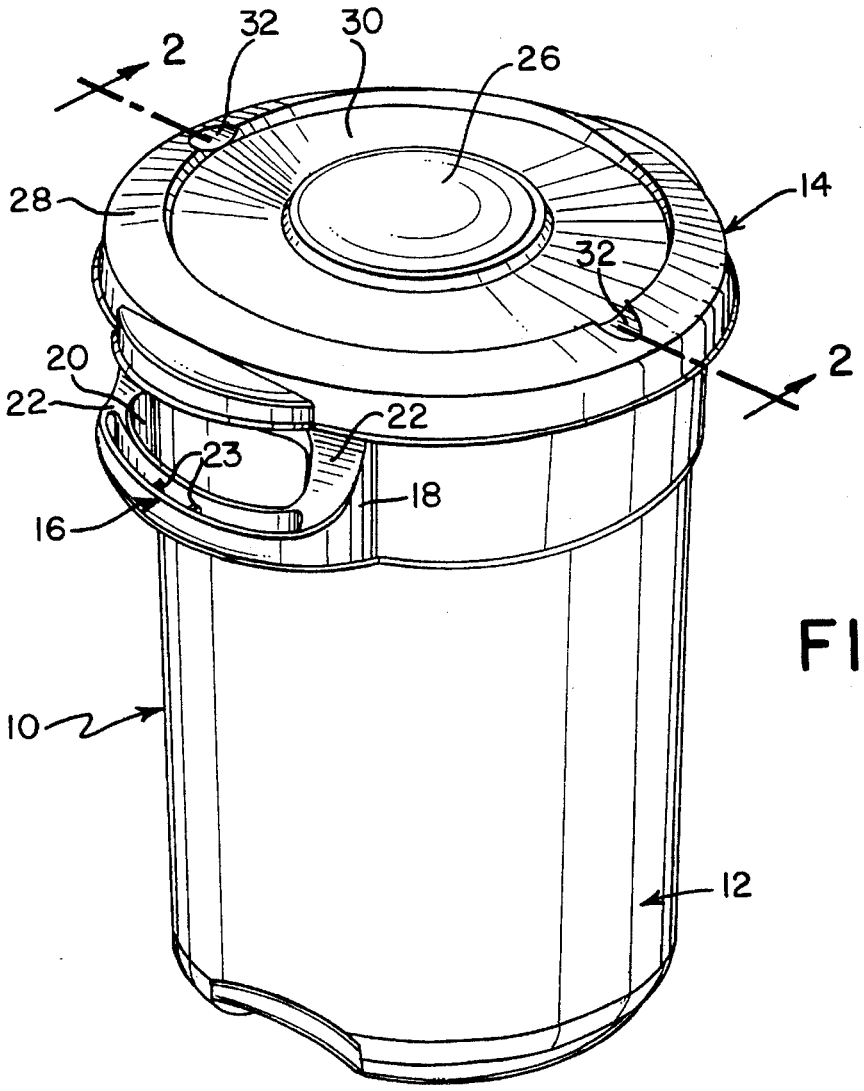
FIG. 1
FIG. 2
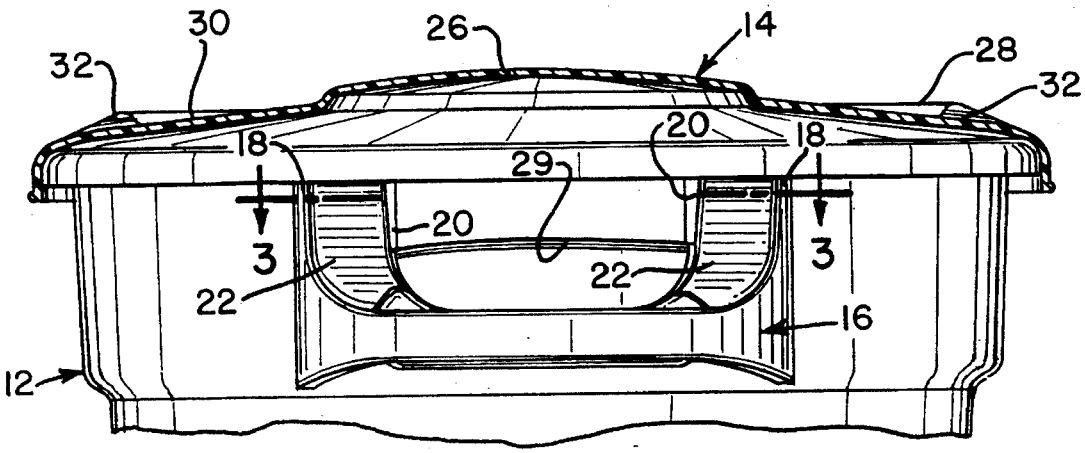

FIG. 5
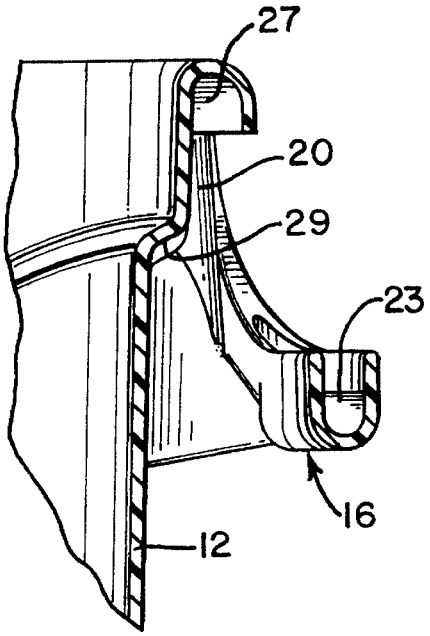
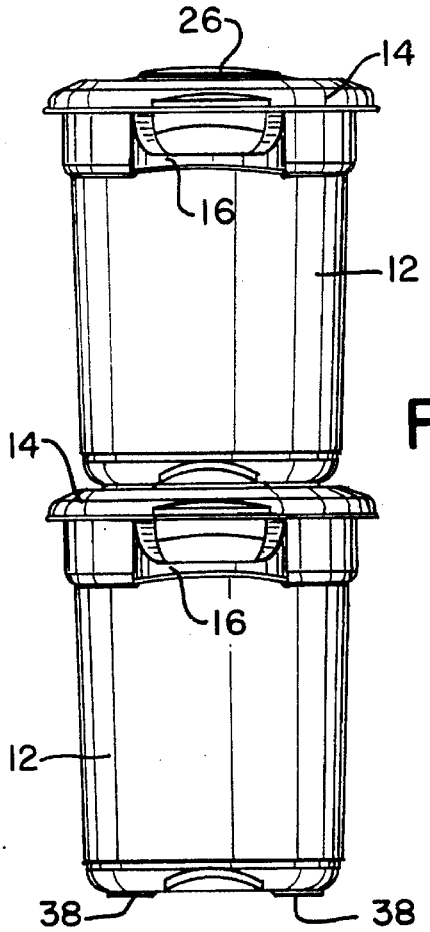
FIG. 6
FIG. 7
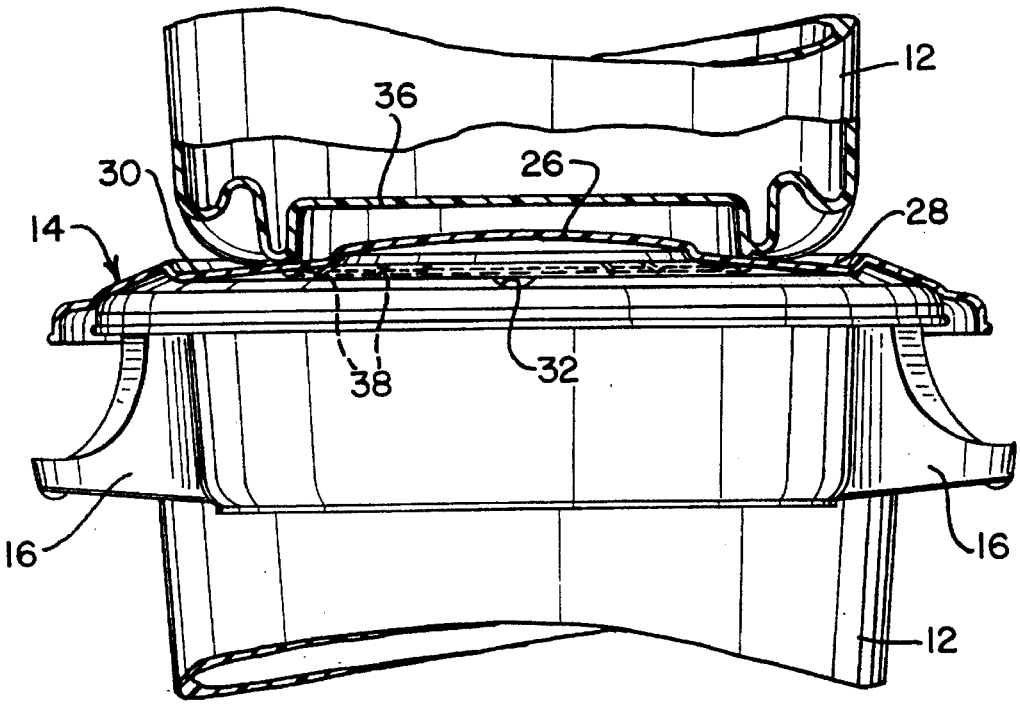

STAKABLE REFUSE CONTAINER WITH IMPROVED HANDLE AND LID DRAIN

This application is a continuation-in-part application of Ser. No. 29/019,209 filed Feb. 25, 1994, entitled REFUSE AND TRASH CONTAINER.

FIELD OF THE INVENTION

The present invention relates to a refuse container. More specifically, the invention relates to a refuse container and associated lid which may be used for storing and transporting goods, the container lid being slightly domed and provided with drain channels. Also, the container body is provided with handles having a novel box-like structure which provides improved strength. The container is also provided with an easily accessible hand grip at its bottom end.

BACKGROUND OF THE INVENTION

Refuse containers are widely used for various applications such as storage and transportation of objects, liquids and other materials. Typically, such refuse containers have a cylindrical body or base portion which is closed at the bottom end. The top end of the cylindrical body portion is adapted to receive a generally circular shaped lid for sealing the cylindrical body. The top end of the cylindrical body is also provided with radially outward extending handles for facilitating the movement and handling of the container.

As most everyone is well aware, the handles of a refuse container are especially important to the continued use and effectiveness of the refuse container. This is due to the fact that the handles which provide the most practical and efficient means for moving the container, especially when loaded, are subjected to a significant amount of force when a refuse container is being transported. Additionally, oftentimes it is impractical and sometimes nearly impossible to move a loaded refuse container by grasping it circumferentially about the outer surface of the body. Thus, the only practical alternative is to lift upward on the handles. However, this results in the handle/body interface being subjected to excessive forces which are proportional to the mass of the material within the container. And, as most everyone is well aware, the handles oftentimes fail when repeatedly subject to these excessive forces. Such failures are extremely undesirable, since, as indicated above, the handles provide the most practical method of transporting a refuse container. Failure of the handles is usually sufficient reason to replace the entire container.

The lid used to seal the top end of the cylindrical body must withstand harsh physical environments, since the refuse container is intended to be left outdoors for extended periods of time. Also, the refuse container may be used in industrial settings where it is subject to being splashed or sprayed by various liquids. In either situation, water or other liquids may impinge on the refuse container, with the result being that the liquid accumulates within any recessed areas of the lid.

Since refuse containers may have a large volume, for example, 20 gallons or more, they are often extremely heavy when loaded. For this reason, refuse containers are often transported on wheeled structures, such as a dolly. However, due to the cylindrical shape of the base or bottom end of the container, it is difficult to manually maneuver the refuse container onto and off of the dolly.

It is therefore an object of the present invention to provide a refuse container having handles capable of withstanding repeated applications of force when moving the refuse container.

It is also an object of the present invention to provide a refuse container which prevents liquid from accumulating in the recessed areas of the lid.

It is an additional object of the present invention to provide a refuse container can easily be transported and/or carried.

SUMMARY OF THE INVENTION

The present invention is a refuse container having handles with two vertical support walls at each point where the handles join the cylindrical body of the refuse container. The two vertical support walls create a box-like section where the handles join the body, which result in a handle/container interface which is extremely rigid and significantly improved with respect to the vertical and lateral load bearing capacity of the handles. In this way, the handle is able to withstand repeated applications of excessive force without failing.

The refuse container of the present invention includes a lid which is slightly domed and provided with one or more drain channels. The drain channels cut through the rim portion of the lid and promote drainage of accumulated water or other liquids out of the recessed portion at the inner part of the lid. In addition, the accumulated water is drained away from the handle areas of the container.

In addition, the refuse container of the present invention includes a domed bottom base corresponding to a similarly domed lid to allow for stable vertical stacking of two or more refuse containers. The domed lid is also provided with a raised rim portion and raised center portion which limit the lateral motion of stacked containers. The refuse container of the present invention is also provided with an indented hand grip integrally formed with the base of the container. The hand grip is used to assist in the placing of the refuse container onto and off of a transporting device such as a dolly. Also, the hand grip is shaped such that it can serve as a yoke to position the container on a person's shoulder when the container is manually carried in an overhead manner.

BRIEF DESCRIPTION OF THE DRAWINGS

The foregoing brief description and further objects, features and advantages of the present invention will be understood more completely from the following description of presently preferred embodiments with reference to the drawings in which:

FIG. 1 is a perspective view of a refuse container according to the present invention;

FIG. 2 is a front elevational view partially in section of a handle portion of the refuse container according to the present invention;

FIG. 5 is a cross section view of the handle portion taken along the line 5—5 of FIG. 4;

FIG. 6 is a front view showing two refuse containers stacked vertically;

FIG. 7 is a partial elevational view partly in section of two refuse containers stacked vertically;

DETAILED DESCRIPTION OF THE PREFERRED EMBODIMENTS

Figure 3:
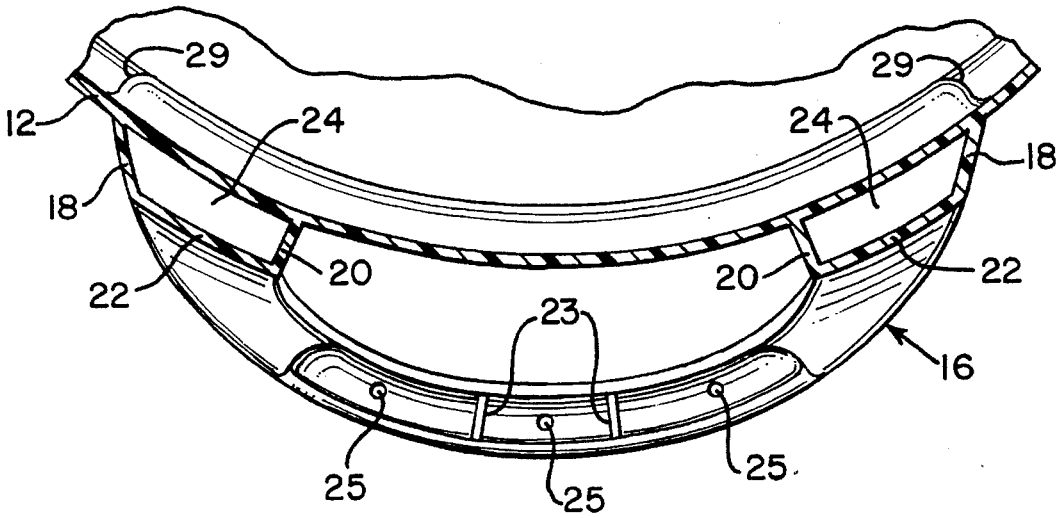
FIG. 3 is a partial cross section view of the handle portion taken along the line 3—3 of FIG. 2.

FIG. 1 illustrates a refuse container 10 according to the present invention. The refuse container 10 includes a generally cylindrical body portion 12 and a generally circular lid 14 which is used to cover the open upper end of the body portion 12. The base of the body portion 12 is sealed. As shown in FIG. 1, the body portion 12 includes one or more handles 16 located on the upper circumference of the body portion and extending in a radially outward direction. Typically, a refuse container is provided with two handles diametrically opposed to each other, and approximately 180 degrees apart.

The refuse container body portion 12 is preferably made of polyethylene, and is formed using well-known and conventional injection molding techniques. The lid 14 is preferably made of injection molded polyethylene, similarly employing well-known and conventional manufacturing processes.

FIGS. 2 and 3 illustrate the two vertical support walls 18, 20 which are provided at each point where handle 16 joins the body 12. Each handle 16 has two points of attachment where it joins the body 12. Each point of attachment includes an inner sidewall 20 and an outer sidewall 18, the sidewalls 18 and 20, in conjunction with connecting wall 22 and the body portion 12 forming a generally box-like structure for attaching the handle 16 to the body 12. The double vertical support wall structure 18, 20 of the handle 16 is shown in further detail in FIG. 3.

Inner sidewall 20 extends outwardly from the body 12 in a radial direction which is substantially perpendicular to the body 12. Outer sidewall 18 extends outwardly from body 12 and in the direction of inner sidewall 20. Sidewalls 18 and 20 are joined by connecting wall 22 and a section of the body portion 12 to form a generally box-like structure 24 for joining the handle 16 to the body 12. While the walls 18, 20 are shown as being angled and perpendicular, respectively, with respect to the body 12, it will be understood by those of ordinary skill in the art that the walls 18, 20 may have alternative orientations with respect to the body 12 without departing from the spirit of the present invention. For example, both walls 18 and 20 may be perpendicular to the body 12, both walls 18 and 20 may be angled toward each other, or wall 18 may be perpendicular and wall 20 angled toward wall 18. Alternatively, one or both of walls 18 and 20 may include a curved portion.

The box or box-like structure 24 significantly increases the rigidity and both the vertical and lateral load bearing capacity of the handle 16. This results in a vastly improved handle which exhibits significantly less failure in response to the repeated application of force. Furthermore, as shown in FIGS. 3 and 5, the circumferential portion of handle 16 is provided with one or more webs 23 which provide support and rigidity to the circumferential portion of the handle. The circumferential handle portion also includes one or more drainage holes 25 for draining accumulated liquid out of the closed bottom of the circumferential handle portion.

Figure 4:
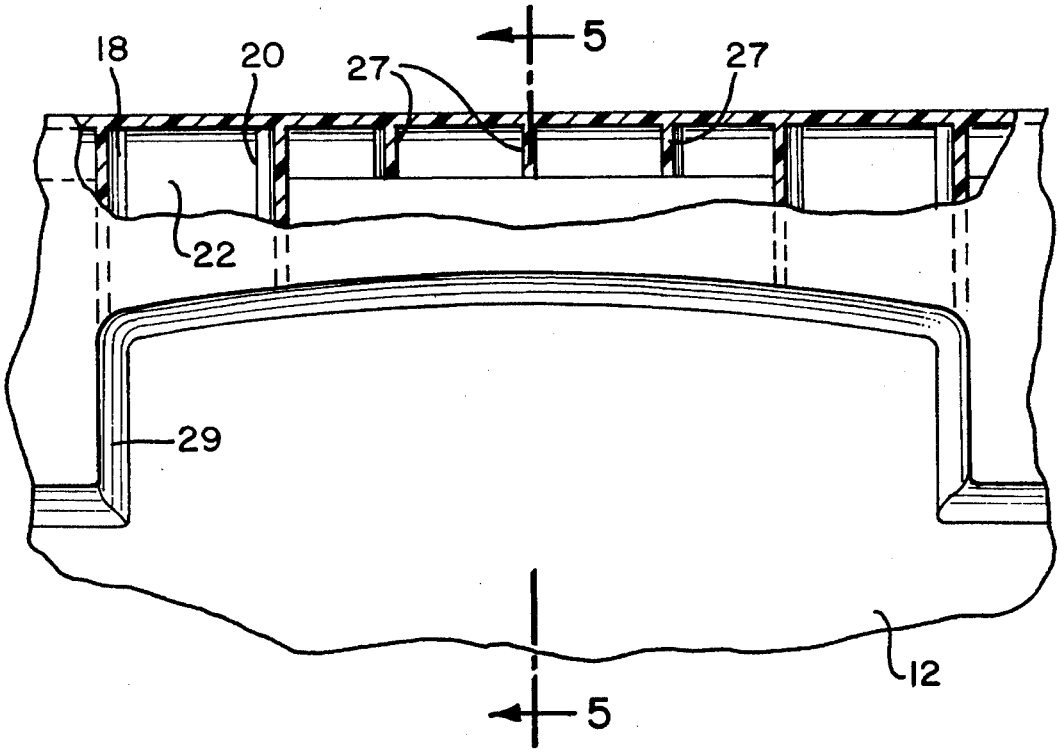
FIG. 4 is partial elevation of an interior portion of the refuse container.

Referring now to FIG. 4, the inside top portion of the body portion 12 is provided with a number of reinforcement ribs 27 which provide increased strength and rigidity in the area of the handle. Also, the upper area of the body portion 12 is provided with an indented ridge 29 which acts to prevent buckling of the body portion 12 when the handle 16 is pulled on.

While the handles 16 are shown as being integrally formed with the body portion 12, it will be understood by those of ordinary skill in the art that the handles 16 may be provided as separate structures which are attached to the body portion 12 by appropriate attachment devices, such as screws, rivets and the like.

As shown in FIGS. 1 and 2, the lid 14 is slightly domed, with the inner portion 26 being higher than the rim portion 28. In between the inner portion 26 and rim portion 28 is a generally toroidal-shaped recessed portion 30 which is recessed with respect to the inner portion 26 and rim portion 28. The lid 14 is provided with one or more drain channels 32 for conducting accumulated liquid out of the recessed portion 30 and through the rim portion 28, where it then flows to the ground. The drain channels 32 are circumferentially positioned on the lid 14 such that when the lid 14 is properly mated to the body 12, with the handle covers 34 positioned over the handles 16, the drain channels do not conduct liquid onto the handles 16. In this manner, the handles are kept dry. While FIG. 1 shows two drain channels 32 diametrically opposite each other and located 90 degrees away from the handles 16, it will be understood by those of ordinary skill in the art that a fewer or greater number of drain channels 32 may be provided circumferentially about the rim portion 28 of the lid 14. Similarly, while the drain channels 32 shown in FIG. 1 are of generally semi-elliptical cross section, it will be understood that they may be formed in any shape which allows the passage of liquids from the recessed portion 30 through the rim portion 28.

Figure 8:
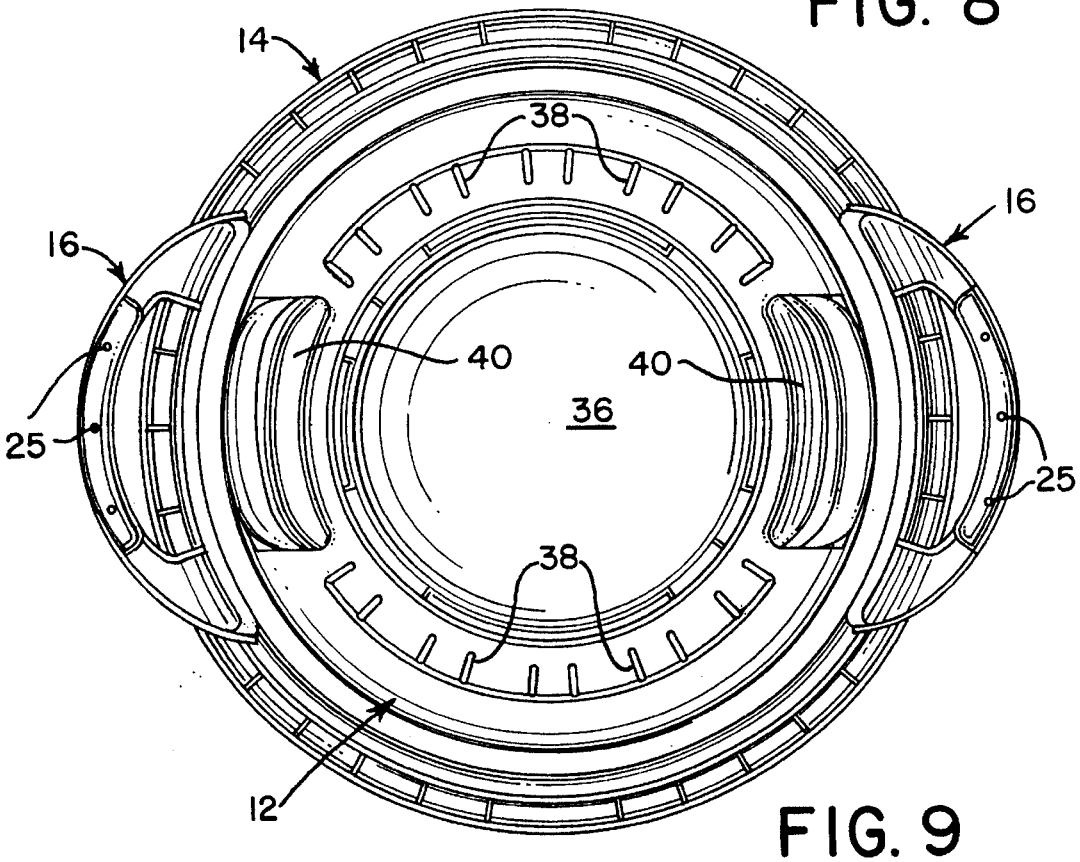
FIG. 8 is a bottom view of the refuse container.

Referring now to FIGS. 7 and 8, the body 12 of the refuse container of the present invention is also provided with a domed bottom portion 36 whose shape generally corresponds to the shape of the lid 14. This allows for the stable vertical stacking of two or more refuse containers, with the bottom of the body portion of one refuse container resting on the lid of another refuse container, as shown in FIG. 6. Specifically, the lateral motion of stacked containers is limited primarily by the raised rim portion 28 and raised inner portion 26 of the lid of a bottom container contacting and retaining the corners and raised bottom portion 37 of the domed bottom portion 36 of a top container.

Also, the domed bottom portion 36 is provided with one or more radially extending ribs 38 which provide additional material to wear away when the container is dragged directly over floor surfaces, without the aid of a dolly. In this manner, the usable life of the container may be extended significantly. In addition, the ribs reduce friction when the container is dragged over a floor surface, since the ribs provide a very small contact patch area which comes into contact with the floor surface. Moreover, the outer annular segments of the ribs 38 provide a stable pin point area which comes in contact with the top surface of a dolly.

Figure 9:
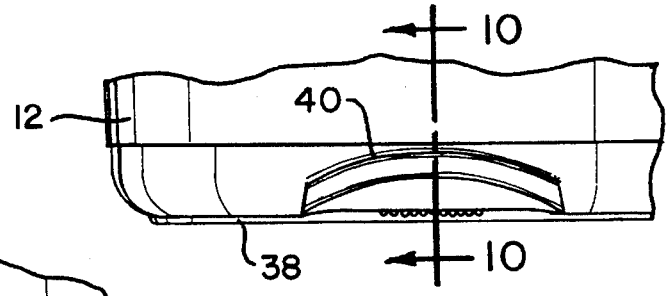
FIG. 9 is a partial front view of the hand grip portion of the refuse container.

FIG. 9 shows the indented hand grip 40 which is integrally formed at the base of the body 12. The hand grip 40 assists in the placing and movement of the refuse container 10. For example, when the refuse container 10 is placed onto a dolly (not shown), a person's hand may be inserted into the indented hand grip 40 to maneuver the refuse container 10. This is made possible due to the fact that the hand grip 40 is indented and provides clearance for each access even when the refuse container 10 is placed on a flat surface.

Figure 10:
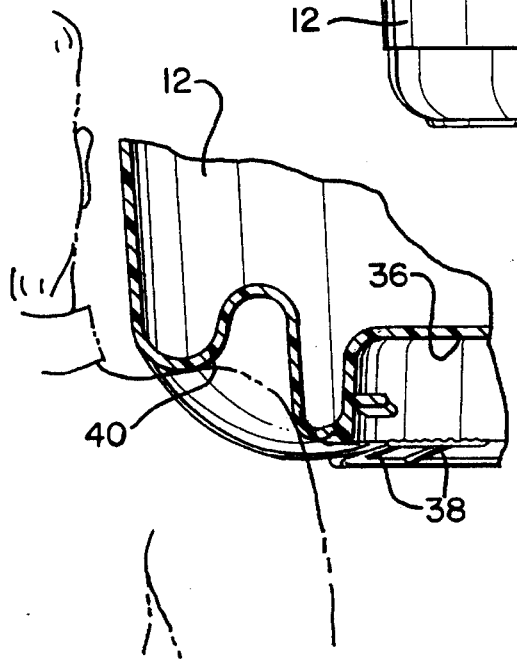
FIG. 10 is a cross section view of the hand grip portion taken along the line 10—10 of FIG. 9.

Also, as illustrated in FIG. 10, the hand grip 40 is shaped such that it may also serve as a yoke to position the refuse container 10 on a person's shoulder when the refuse container 10 is manually carried in an overhead manner.

While the invention has been particularly shown and described with reference to preferred embodiments thereof, it will be understood by those skilled in the art that various changes in form and detail may be made therein without departing from the spirit and scope of the invention.

What is claimed is:

1. A refuse container comprising:

a substantially cylindrical body portion having a closed bottom end and an open top end;

and a generally circular lid for sealing the open end of the body portion, said lid comprising a raised inner portion and a raised rim portion, said inner portion being higher than said rim portion, said inner portion and said rim portion forming a recessed channel therebetween, and said rim portion having at least one indented and inclined drain channel for draining accumulated liquid from said recessed channel.

2. A refuse container according to claim 1, further comprising one or more outwardly extending handles located at the top end of the body portion and extending in a radial direction, each of said one or more handles comprising a double wall at a point where each handle joins the body portion, the double wall forming part of a box-like structure joining each handle to the body portion.

3. A refuse container according to claim 2, wherein said bottom end of said body portion is shaped to correspond to a second similar lid, whereby the bottom end of said body portion is adapted to receive and substantially prevent lateral motion of said refuse container with respect to said second lid of a second refuse container when said refuse container is stacked vertically onto said second refuse container.

4. A refuse container according to claim 1, wherein said body portion further comprises an indented access aperture at said bottom end.

5. A refuse container according to claim 1, wherein said bottom end of said body portion is provided with a plurality of radially extending ribs which provide a reduced contact area which substantially comes into contact with a surface thereby reducing contact of said body portion with said surface.

6. A refuse container comprising:

a substantially cylindrical body portion having a closed bottom end and an open top end;

one or more outwardly extending handles located at the top end of the body portion and extending in a radial direction, each of said one or more handles comprising a double wall at a point where each handle joins the body portion, the double wall forming part of a box-like structure joining each handle to the body portion; and a generally circular lid for closing the open top end of the body portion, wherein said lid comprises a raised inner portion and a raised rim portion, said inner portion being higher than said rim portion, said inner portion and said rim portion forming a recessed channel therebetween, and said rim portion having at least one indented and inclined drain channel for draining accumulated liquid from said recessed channel.

7. A refuse container according to claim 6, wherein said bottom end of said body portion is shaped to correspond to a second similar lid, whereby the bottom end of said body portion is adapted to receive and substantially prevent lateral motion of said refuse container with respect to said second lid of a second refuse container when said refuse container is stacked vertically onto said second refuse container.

8. A refuse container comprising: a substantially cylindrical body portion having a closed bottom end and an open top end, said body portion further comprising an indented access aperture at said bottom end;

a generally circular lid for closing the open top end of the body portion wherein said lid comprises a raised inner portion and a raised rim portion, said inner portion being higher than said rim portion, said inner portion and said rim portion forming a recessed channel therebetween, and said rim portion having at least one indented and inclined drain channel for draining accumulated liquid from said recessed channel; and one or more outwardly extending handles located at the top end of the body portion and extending in a radial direction, each of said one or more handles comprising a double wall at a point where each handle joins the body portion, the double wall forming part of a box-like structure joining each handle to the body portion.

9. A refuse container according to claim 8, wherein said bottom end of said body portion is shaped to correspond to a second similar lid, whereby the bottom end of said body portion is adapted to receive and substantially prevent lateral motion of said refuse container with respect to said second lid of a second refuse container when said refuse container is stacked vertically onto said second refuse container.

* * * * *